US009045151B2

(12) United States Patent
Duan

(10) Patent No.: US 9,045,151 B2
(45) Date of Patent: Jun. 2, 2015

(54) TRACK BARCODE SYSTEMS FOR RAILROAD MANAGEMENT

(71) Applicant: Shizhong Duan, Vancouver (CA)

(72) Inventor: Shizhong Duan, Vancouver (CA)

(73) Assignee: TECH4U Dynamics Inc., Vancouver, BC (CA)

( * ) Notice: Subject to any disclaimer, the term of this patent is extended or adjusted under 35 U.S.C. 154(b) by 0 days.

(21) Appl. No.: 14/224,067

(22) Filed: Mar. 25, 2014

(65) Prior Publication Data

US 2014/0367462 A1 Dec. 18, 2014

Related U.S. Application Data

(60) Provisional application No. 61/836,522, filed on Jun. 18, 2013.

(51) Int. Cl.

| | |
|---|---|
| ***G06K 7/10*** | (2006.01) |
| ***G06F 17/00*** | (2006.01) |
| ***G06F 7/00*** | (2006.01) |
| ***G07B 15/02*** | (2011.01) |
| ***G05D 1/00*** | (2006.01) |
| ***G05D 3/00*** | (2006.01) |
| ***G01C 21/00*** | (2006.01) |
| ***B61L 25/02*** | (2006.01) |

(52) U.S. Cl.

CPC ..... *B61L 25/02* (2013.01)

(58) Field of Classification Search

USPC ..... 235/376, 384, 375, 454, 462.01; 701/19, 20, 200

See application file for complete search history.

(56) References Cited

U.S. PATENT DOCUMENTS

| | | | | |
|---|---|---|---|---|
| 3,639,731 | A * | 2/1972 | McNeill | 701/32.9 |
| 4,160,522 | A * | 7/1979 | Dikinis | 235/454 |
| 4,293,766 | A * | 10/1981 | Long et al. | 235/454 |
| 4,362,456 | A * | 12/1982 | Barry | 414/334 |
| 4,864,306 | A * | 9/1989 | Wiita | 342/42 |
| 7,624,952 | B1 * | 12/2009 | Bartek | 246/124 |
| 8,073,581 | B2 * | 12/2011 | Morris et al. | 701/19 |
| 2002/0102910 | A1 * | 8/2002 | Donahue et al. | 446/465 |
| 2002/0134835 | A1 * | 9/2002 | Kennedy | 235/384 |
| 2003/0148698 | A1 * | 8/2003 | Koenig | 446/15 |
| 2003/0155470 | A1 * | 8/2003 | Young et al. | 246/122 A |
| 2009/0309733 | A1 * | 12/2009 | Moran et al. | 340/572.1 |
| 2010/0131185 | A1 * | 5/2010 | Morris et al. | 701/200 |
| 2010/0168940 | A1 * | 7/2010 | King | 701/20 |
| 2014/0367462 | A1 * | 12/2014 | Duan | 235/375 |

* cited by examiner

*Primary Examiner* — Daniel Walsh

(57) ABSTRACT

This invention is related to an economic and practical method of using barcode systems for the management of railroad tracks. The systems consist of barcodes and device(s) which can optically read and decode the barcodes. The barcodes are permanently installed on one or both rails of a railroad track at predetermined locations along the track. The barcodes include coded contents such as track location coordinates and other railroad property information along the track. By using these novel track barcode systems, sections of problematic tracks could be accurately located either manually or automatically for repeatable monitoring, repairing or replacement purposes.

10 Claims, 6 Drawing Sheets

TRACK BARCODE SYSTEMS FOR RAILROAD MANAGEMENT

CROSS-REFERENCE TO RELATED APPLICATIONS

Application No. 61/836,522
Filing or 371(c) Date: Jun. 18, 2013
Confirmation No.: 5777

BACKGROUND OF THE INVENTION

This invention relates to the utilization of track barcode systems to provide marking and identification for each and every section of a railroad track. The barcodes consisting of each and every unique barcode provide accurate and fixed reference points or coordinates of the track for monitoring, repairing and replacement of railroad track sections. Other railroad properties such as rail types, railroad ties and etc. could also be coded into the barcodes for associated railroad management purposes.

Railroad tracks are consistently monitored by using sensors based on optical, capacitive, eddy current measurements and other mechanisms throughout their lifespan of service. The track gauge between the two paralleled rails and individual rail profile are examples of the parameters that need to be measured and monitored closely for the safety of train operation. Based on modern sensor and automation technologies, the track gauge and rail profile can be measured automatically and accurately at any specific point of the track. In order to calculate rail profile wear or track gauge variation over time, however, it is critical to have accurate and fixed track location identifications for each and every measurement made. Without accurate location repeatability, individual track gauge and rail profile measurements are not very useful no matter how accurate they are.

One of the track section identification methods is to use the existing global positioning system (GPS). However, the current GPS system can only provide location accuracy up to a few meters, which is not accurate enough for the purpose of monitoring track wear. Besides, geographical environment around the monitored tracks, such as underground tunnels, surrounding mountains and nearby tracks, may affect the performance or accuracy of the GPS system as well. In order to calculate the amount of track wear between two measurements taken at two different times, for example, it is necessary to overlap the two rail profiles using a common track location coordinate. Without accurate location identifications, it is impossible to calculate the track wear accurately, even though both individual rail profiles are accurate themselves.

Another track positioning method is to use the existing posts or marks that are located beside and along the railroad tracks. However, it is a very challenging task for a measuring vehicle to detect those posts or marks automatically, since those posts or marks share no standard relative position against the tracks or standard appearance. Manual identification of those reference posts was occasionally adopted, and the location triggers were inputted to a measurement system manually. However, the accuracy and repeatability of manual triggers were not satisfactory due to inevitable human error in this manual operation.

Yet another track positioning method is to use RFID (radio frequency identification) chips and a corresponding chip detector. Since RFID technology is based on radio frequency technology and radio signal could be detected from all directions, the corresponding positioning accuracy is a distance of plus or minus a few feet. Another disadvantage of RFID technology is the high costs associated with a vast amount of RFID chips that should be positioned along the track with a predetermined spacing.

The method of the present invention is to use a track barcode system including an array of pre-coded barcodes and one or more scanners to provide accurate, repeatable and unique track location identifications that could be used by any railroad track management systems. Barcode technologies have been established and are widely used in daily life applications such as library computers, supermarket check-outs and on automated production lines. Outdoor weather-proof barcode sticks were used on the vehicle identification plates which could stay as long as the life of the vehicle. One dimensional and two dimensional barcodes are available. Those barcodes are much more affordable than RFID chips. The corresponding high speed barcode scanners which are capable to carry out thousands of scans per second are also readily available. The trigger signals and the readings generated by the barcode scanners could be transmitted into any existing track measurement systems. Those triggers and location identifications are the important data that could provide the common yet repeatable track coordinates to synchronize different track measurement systems based on a single moving vehicle or different vehicles.

Depending on the size and the orientation of the barcodes, the scan rate of the scanner and the speed of the moving vehicle carrying the scanner, the position accuracy resulted from the method of the present invention could be in a range of a few centimeters or even better. Although this barcode application for railroad track management systems is novel, the barcode technology adopted in the method of the present invention is a solid and proved one. The implementation of a track barcode system for railroad management systems, such as the existing track gauge and rail profiling measurement systems, is economic yet practical.

BRIEF SUMMARY OF THE INVENTION

In accordance with the present invention, a track barcode system is provided. The track barcode system includes a plurality of barcodes to encode contents such as track location coordinates and other railroad property information; a plurality of labels carrying the plurality of barcodes on a one-for-one basis, wherein the plurality of labels are attached firmly to a rail of a railroad track at predetermined locations along the railroad track to mark the track location coordinates and other railroad property information; one or more barcode scanners capable of reading and decoding the plurality of barcodes optically, to provide the contents of the plurality of barcodes; and a vehicle capable of moving on the railroad track, to carry the one or more barcode scanners and direct the one or more barcode scanners at the plurality of barcodes; wherein the plurality of labels include a plurality of covers, in a manner of one cover for one label for preventing the plurality of labels from dust or other pollutions, wherein the cover includes a hinge mechanism to allow the cover to be flipped over so that the one or more barcode scanners can scan the label.

In accordance with the present invention, a track barcode system is provided. The track barcode system includes a plurality of barcodes to encode contents such as track location coordinates and other railroad property information; a plurality of labels carrying the plurality of barcodes on a one-for-one basis, wherein the plurality of labels are attached firmly to a rail of a railroad track at predetermined locations along the railroad track to mark the track location coordinates and other railroad property information; one or more barcode scanners capable of reading and decoding the plurality of barcodes optically, to provide the contents of the plurality of barcodes; and a vehicle capable of moving on the railroad track, to carry the one or more barcode scanners and direct the one or more barcode scanners at the plurality of barcodes; wherein the vehicle includes a gas or liquid nozzle, wherein the gas or liquid nozzle blows gas or inject liquid respectively to the plurality of labels to clean the plurality of labels before the one or more barcode scanners read and decode the plurality of barcodes.

In accordance with the present invention, a track barcode system is provided. The track barcode system includes a plurality of barcodes to encode contents such as track location coordinates and other railroad property information; a plurality of labels carrying the plurality of barcodes on a one-for-one basis, wherein the plurality of labels are attached firmly to a rail of a railroad track at predetermined locations along the railroad track to mark the track location coordinates and other railroad property information; one or more barcode scanners capable of reading and decoding the plurality of barcodes optically, to provide the contents of the plurality of barcodes; and a vehicle capable of moving on the railroad track, to carry the one or more barcode scanners and direct the one or more barcode scanners at the plurality of barcodes; wherein the vehicle includes both a liquid nozzle and a gas nozzle, wherein the liquid nozzle and the gas nozzle injects liquid firstly and blows gas secondly to the plurality of labels to wash, clean and dry the plurality of labels before the one or more barcode scanners read and decode the plurality of barcodes.

DETAILED DESCRIPTION OF THE INVENTION

Figure 1A:
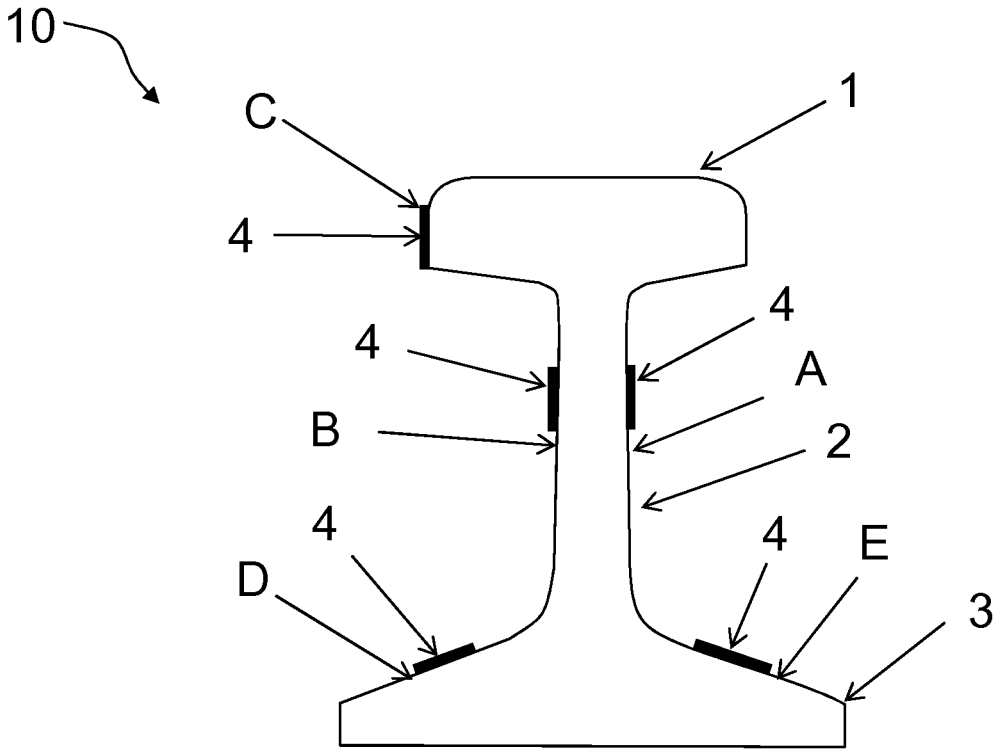
FIG. 1A provides a schematic diagram of a rail and the possible installation positions of the barcode on the rail related to the track barcode system of the present invention.
Figure 1B:
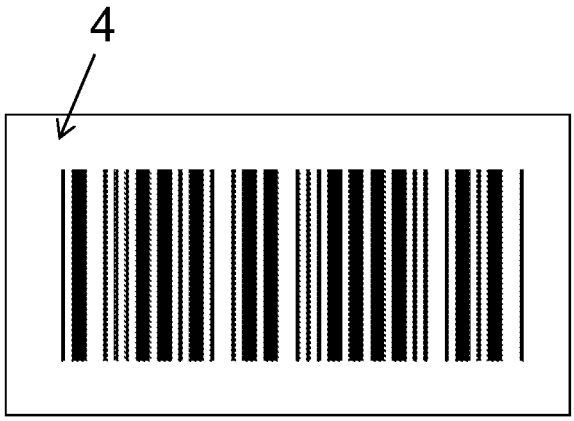
FIG. 1B shows a front view of a typical linear or one-dimensional barcode used in FIG. 1A.
Figure 1C:
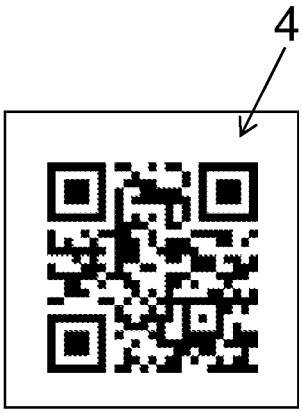
FIG. 1C shows a front view of a typical matrix or two-dimensional barcode used in FIG. 1A.

FIG. 1A shows the possible locations for the installation of the barcode 4 on the surface of a rail 10. FIG. 1B shows a typical one-dimensional barcode. FIG. 1C shows a typical two-dimensional barcode. Both the one-dimensional barcodes and the two-dimensional barcodes could be used for the track barcode systems of the present invention. As shown in FIG. 1A, a typical rail 10 consists of rail head 1, web 2 and rail foot 3. Barcode 4 could be attached firmly to location A which is located on the inside surface of the web facing the other rail of the track (not shown), or location B on the outside surface of the web opposite to the other rail of the track. Location C at the rail head 1 outside of the tracks is another possible location for barcode 4 installation. Although the barcode 4 at location C is very close to the moving wheels of the train (not shown), there is no contact between the barcode 4 and the rotating wheels of the train. Location E and D are also two potential locations to install the barcode 4. However, barcode 4 installed at location E or D has higher chances to be covered by dusts or stone track ballast (not shown). The barcode 4 could be directly printed or etched onto the surface of the rail 10. If a label is used, the barcode label 4 could be attached to the surface of the rail 10 by using permanent glue. If metal barcode label 4 is used, other methods such as spot welding and mechanical screws could also be used to fasten the barcode label 4 to the rail 10.

Based on different applications, various types of information related to the railroad track management could be coded in the barcode 4 shown in FIG. 1B and FIG. 1C. The information may include track location coordinates, rail type, tie identification and wayside assets such as switch, signal, intersection and many more.

Figure 2A:
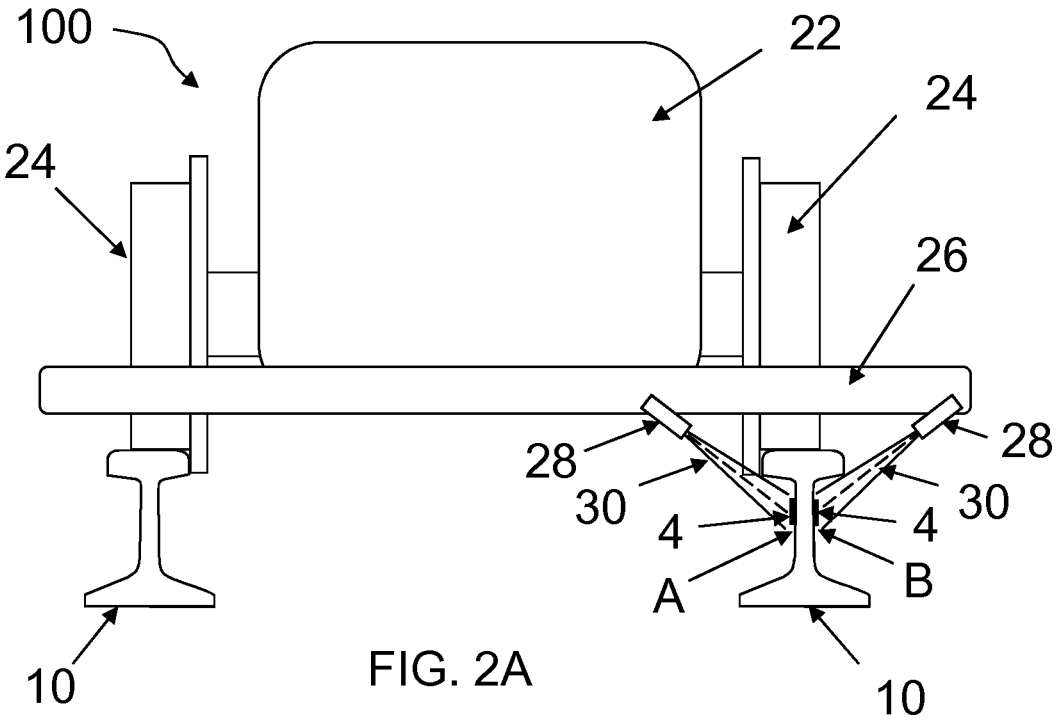
FIG. 2A provides a front view of one arrangement of the track barcode system of the present invention.
Figure 2B:
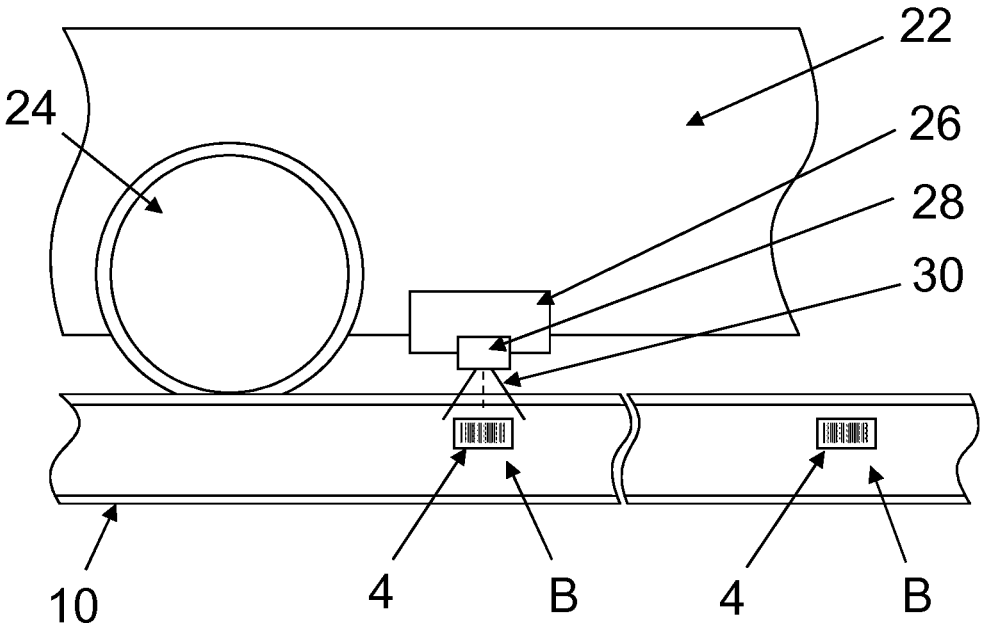
FIG. 2B provides a side view of the arrangement of the track barcode system in FIG. 2A.

FIG. 2A and FIG. 2B show the first embodiment of the track barcode system 100 of the present invention. FIG. 2A shows the front view of the track barcode system 100. FIG. 2B shows the side view of the track barcode system 100. Although the one-dimension barcode shown in FIG. 1B has the bars aligned vertically, horizontal barcode could also be used. One major component of the track barcode system 100 consists of an array of pre-coded barcode labels 4 installed on the rail 10 along the railroad track at a predetermined spacing as shown in FIG. 2B. Another major component of the track barcode system 100 consists of one or two barcode scanner(s) 28 as shown in FIG. 2A. The scanner(s) 28 is (are) attached to a structural beam 26 which in turn is attached to a vehicle 22 movable on wheels 24 along the railroad track consisting of two rails 10.

In the most simplified configuration of the barcode system 100, only a pair of barcodes and scanner combination is necessary. The combination could consist of an array of barcode labels 4 installed at location A of the rail along the track and a single barcode scanner 28 installed between the two rails as shown in FIG. 2A. The combination could also consist of an array of barcode labels 4 at location B and a single barcode scanner 28 installed on the corresponding side of the vehicle 22 as shown in FIG. 2A. The orientation of the scanner 28 is adjusted so that the scanner 28 is pointing to the barcode 4 through the optic beam 30 and capable of reading the barcode 4, as shown in FIG. 2A. Ideally, the location of the scanner 28 should be above the ground level defined by the two heads of the rails 10, in order to avoid collision and damage of the scanner 28 when the vehicle is moving.

With the vehicle 22 moving on the track, the scanner 28 scans continuously. If a barcode is detected, the scanner 28 can de-code the barcode which carries the coordinate information and other track or rail properties of the specific position where the barcode is installed. The scanner 28 can send the coordinate information associated with the specific barcode 4 and a trigger signal to any track management systems (not shown) mounted on the vehicle 22. Those track management systems include measurement system, grinding system, tamping system and etc. With the coordinate information supplied by the track barcode system 100 of the present invention, other track management systems can have accurate and repeatable track coordinates that are very important for track monitoring and other track management purposes.

In a more complex configuration of the track barcode system 100, two or more pairs of barcodes and scanner combination could be adopted. FIG. 2A shows two pairs of barcodes and scanner combination. A total of four scanners 28, with two scanners for each rail, could be installed on a single structural beam 26 if necessary. The configuration with multiple scanners has an added feature. If a specific barcode in one array is damaged somehow, the corresponding barcode in another array could be used to identify the location of the damaged barcode. Therefore, identification, repairing or replacement of the damaged barcode 4 is possible. Multiple scanners could increase the reliability of the track barcode system 100 of the present invention.

Figure 3:
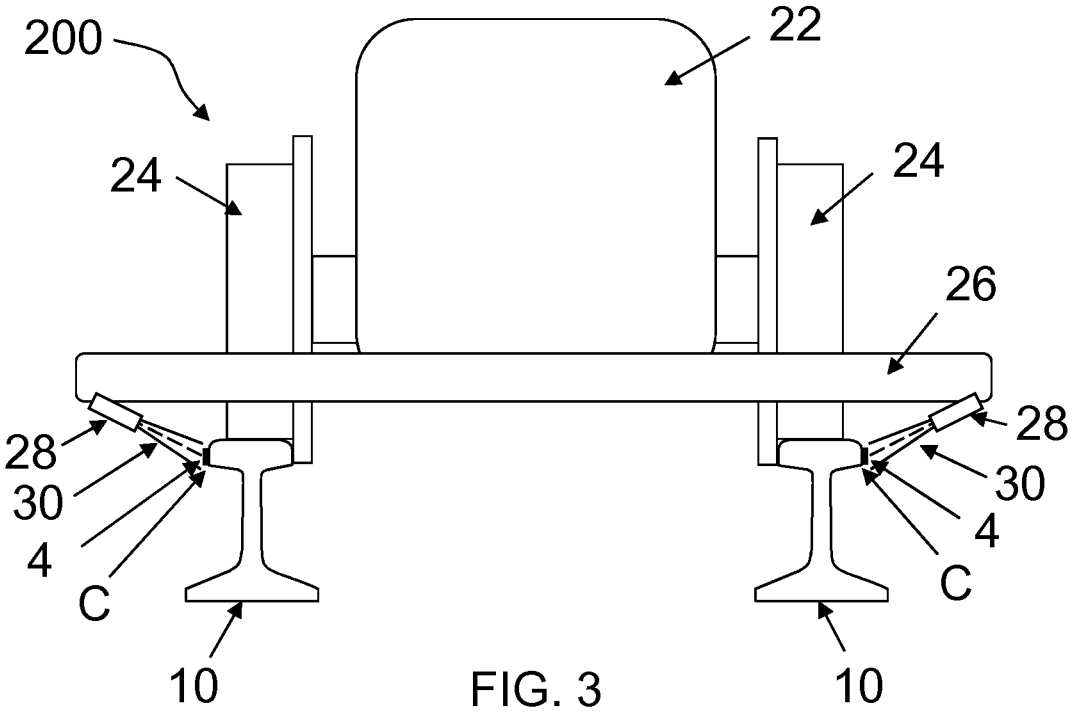
FIG. 3 shows a front view of another arrangement of the track barcode system of the present invention.

FIG. 3 shows the second embodiment of the track barcode system 200 of the present invention. Comparing to the track barcode system 100 described above, the major difference in this arrangement is the installation location of the barcodes 4. The barcodes 4 are installed at location C on the head of the rail 10. In order to avoid the direct contact of the barcode 4 with the moving wheels 24, which could destroy the barcode easily, the location C has to be on the external side of the rail head as shown in FIG. 3. For each array of barcodes 4, a barcode scanner 28 is needed. Similar to the track barcode system 100 of the present invention, the barcode scanner is installed on the structural beam 26, which in turn is attached to the vehicle 22 that has wheels 24. The barcode scanner is directed to scan and read the barcodes 4 through the scanning light beam 30. A pair of barcodes and scanner combination is enough to provide the required track coordinates for all track management systems. When two pairs of barcodes and scanner combination are used, the track barcode system 200 of the present invention adds another cross-checking feature for barcode self-maintenance. One could use barcode labels from one array to identify and fix the problems of the barcode labels that belong to the other array, as long as that the two barcode labels of the two arrays at the same track location do not fail at the same time. In the case that both barcode labels fail, one could still use the neighboring barcodes that belong to the same barcode array to identify the failing barcode label or labels.

Comparing to the barcode location of the track barcode system 100, the barcode location of the track barcode system 200 of the present invention has an advantage of easier access. It will be relatively easier to design an automated barcode installation machine if location C of the rail 10 is selected as the location for the barcode installation. It will also be easier for maintenance workers to use handheld smart phone or scanner to read the label and identify the specific tie that is monitored and needs to be replaced. The associated disadvantage is that the barcode 4 may be too close to the head of the rail 10, especially in the case of track grinding operation.

Figure 4:
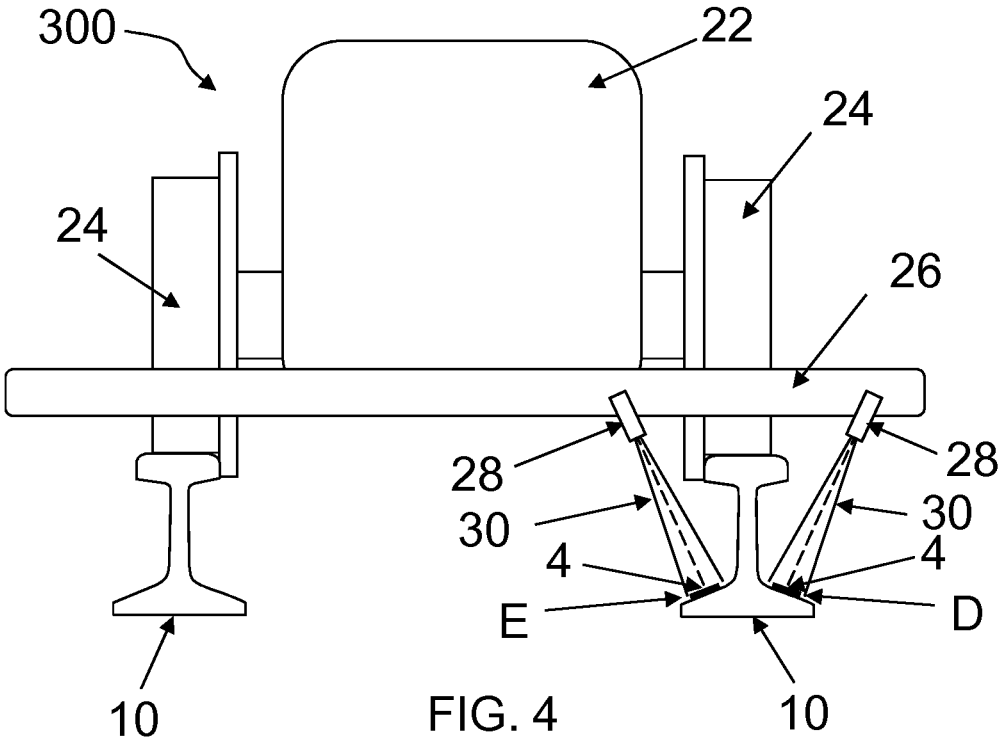
FIG. 4 shows a front view of yet another arrangement of the track barcode system of the present invention.

FIG. 4 shows the third embodiment of the track barcode system 300 of the present invention. Comparing to the track barcode system 100, the major difference of the track barcode system 300 is the installation location of the barcode 4. The barcode 4 is now installed on location E or location D on the foot of the rail 10. Except for the barcode location, and the corresponding orientation adjustment of the scanners 28, all other aspects of the track barcode system 300 are similar to that of the track barcode system 100 of the present invention.

The advantage of the barcode location related to the track barcode system 300 is that the scanning light beam 30 from the scanner 28 is almost perpendicular to the barcode 4, which may make the scanning process easier or quicker. However, the disadvantage associated with the barcode location of the track barcode system 300 is that the barcode maybe easily covered by dusts and/or stone track ballasts around the barcode labels.

Figure 5A:
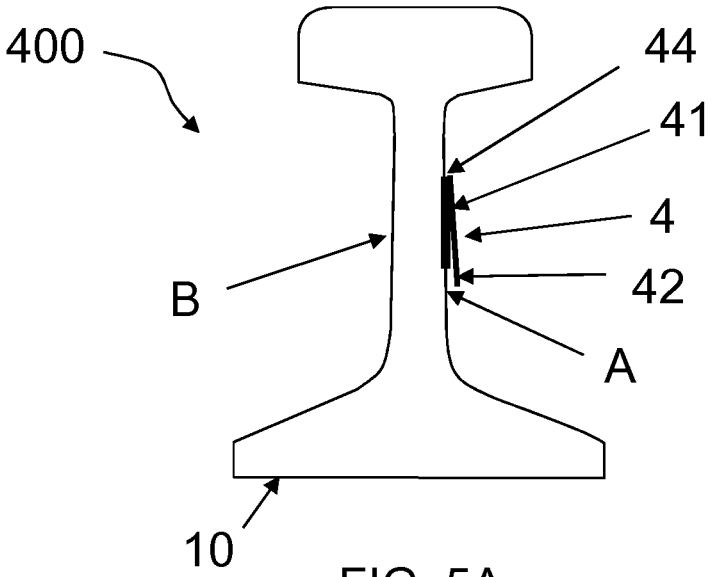
FIG. 5A shows a schematic diagram of a barcode with a protective cover on a rail before or after barcode scanning.
Figure 5B:
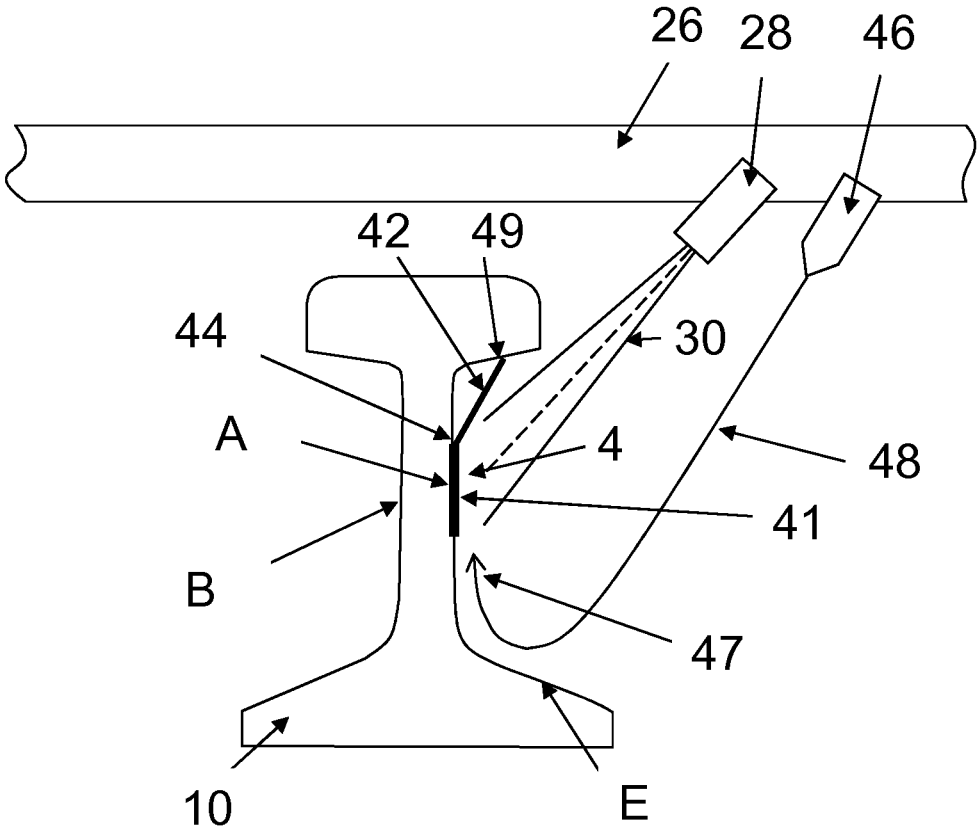
FIG. 5B shows a schematic diagram of a barcode with a protective cover on a rail during barcode scanning.

FIG. 5A and FIG. 5B show another embodiment of the track barcode system 400 of the present invention. The individual barcode assembly 4 of the track barcode system 400 consists of a barcode label 41, a cover 42 and a hinge mechanism 44. The hinge 44 connects the label 41 together with the cover 42. The hinge 44 should be a low friction one, so that the cover 42 can be flipped over easily. FIG. 5A shows the barcode 4 with the cover 42 at the down position under the effect of gravity on the weight of the cover 42. The barcode assembly 4 is firmly attached to the web of rail 10 at either location A or location B.

FIG. 5B shows the barcode assembly 4 when the barcode label 41 is under scanning. The scanner 28 is attached to a structural beam 26 similar to the track barcode system 100 of the present invention. Near the scanner 28, an air nozzle 46 is also attached to the beam 26. An air compressor (not shown) mounted on the vehicle (not shown) supplies the compressed air to the nozzle 46. The nozzle 46 blows a stream of air 48 against the foot E of the rail 10. When the air stream 48 hits the foot, it turns up against the curvature of the rail around the foot E as shown by 47. The upward air stream 47 blows against the cover 42 of the barcode assembly 4, so that the cover 42 is flipped over around the hinge 44. With the air nozzle 46 energized, the cover 42 stabilizes at an up position as shown in FIG. 5B. In the up position, the free end of the cover 42 contacts the lower surface 49 of the rail head. With the cover 42 at its up position, the scanner 28 can scan and read the barcode label 41 as if there were no cover 42. After scanning, the air stream 48 and 47 released from nozzle 46 moves with the moving vehicle (not shown). Without the air steam 47 presented, the cover 42 falls down due to the gravity force to cover and protect the barcode label 41.

The advantage of using barcode assembly 4 in the track barcode system 400 of the present invention is to provide an extra layer of protection for the barcode label 41 from dusts, rains, sparks of a grinding machine and etc. The disadvantage of the barcode system 400 is the added costs associated with barcode assembly 4, air nozzle 46 and the required air compressor (not shown).

Figure 6:
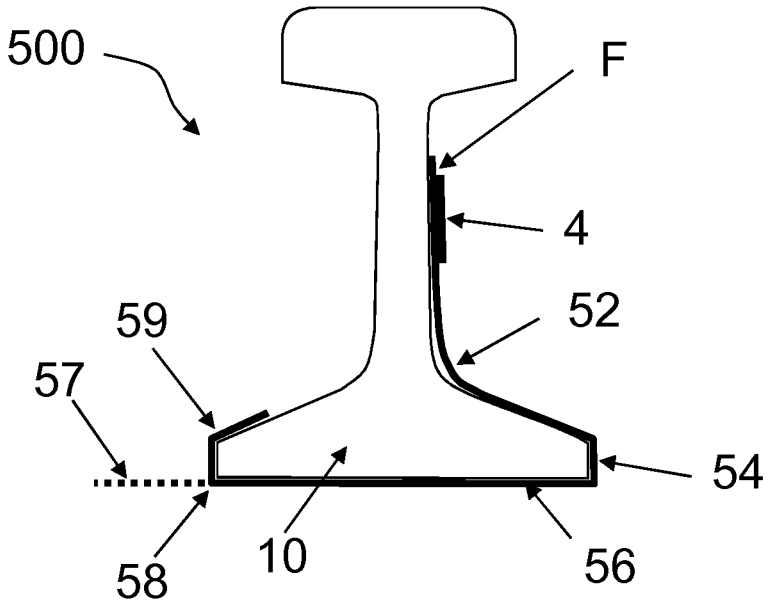
FIG. 6 shows a schematic diagram of an alternative method for barcode installation on the rail.

FIG. 6 shows yet another embodiment of the track barcode system 500 of the present invention. This track barcode system takes advantage of the lower portion of the rail for barcode installation. As shown in FIG. 6, the barcode 4 is attached to a bendable thin plate 56 at location F. The bendable plate 56 could be a metal plate or plastic plate. The thin plate 56 has been pre-bent according to the foot contour of the rail 10 at locations 52 and 54. The thin plate 56 with barcode 4 could be inserted under the rail. In order for the insertion of the thin plate 56, stone track ballast under the rail 10 may need to be replaced during the installation. The dashed line 57 represents the thin plate 56 before being bent. The portion 57 of the thin plate 56 is then bent at location 58 and location 59 to wrap around the foot of the rail 10. Glue between the thin plate 56 and the surface of the rail 10, or other mechanical fastening methods may not be necessary in this configuration. Barcode label 4 may be glued to the plate 56. The surface of the plate 56 could be custom designed or prepared for the barcode 4 installation in this configuration.

Figure 7:
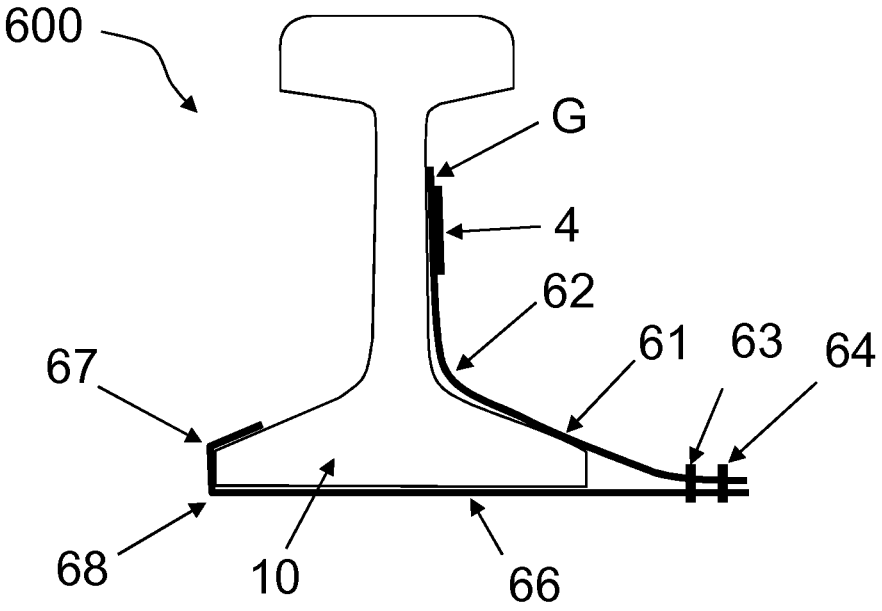
FIG. 7 shows a schematic diagram of another alternative method for barcode installation on the rail.

FIG. 7 shows yet another embodiment of the track barcode system 600 of the present invention. The barcode installation of the track barcode system 600 is similar to that of the track barcode system 500. The difference is that there are two pieces of the thin plate 61 and 66 in the track barcode system 600 comparing to only one plate 56 in the track barcode system 500. As shown in FIG. 7, the barcode 4 is attached to the plate 61 at location G. The plate 66 has been pre-bent at location 68 and location 67 according to the contour of the foot of the rail 10. The plate 66 is then inserted under the rail 10 as shown in FIG. 7. The plate 61 and plate 66 is then attached together using bolts, nuts or rivets, or other mechanical fasteners 63 and 64. Similar to the track barcode system 500, this configuration allows clean or controlled surface at location G for barcode 4 installation.

Figure 8:
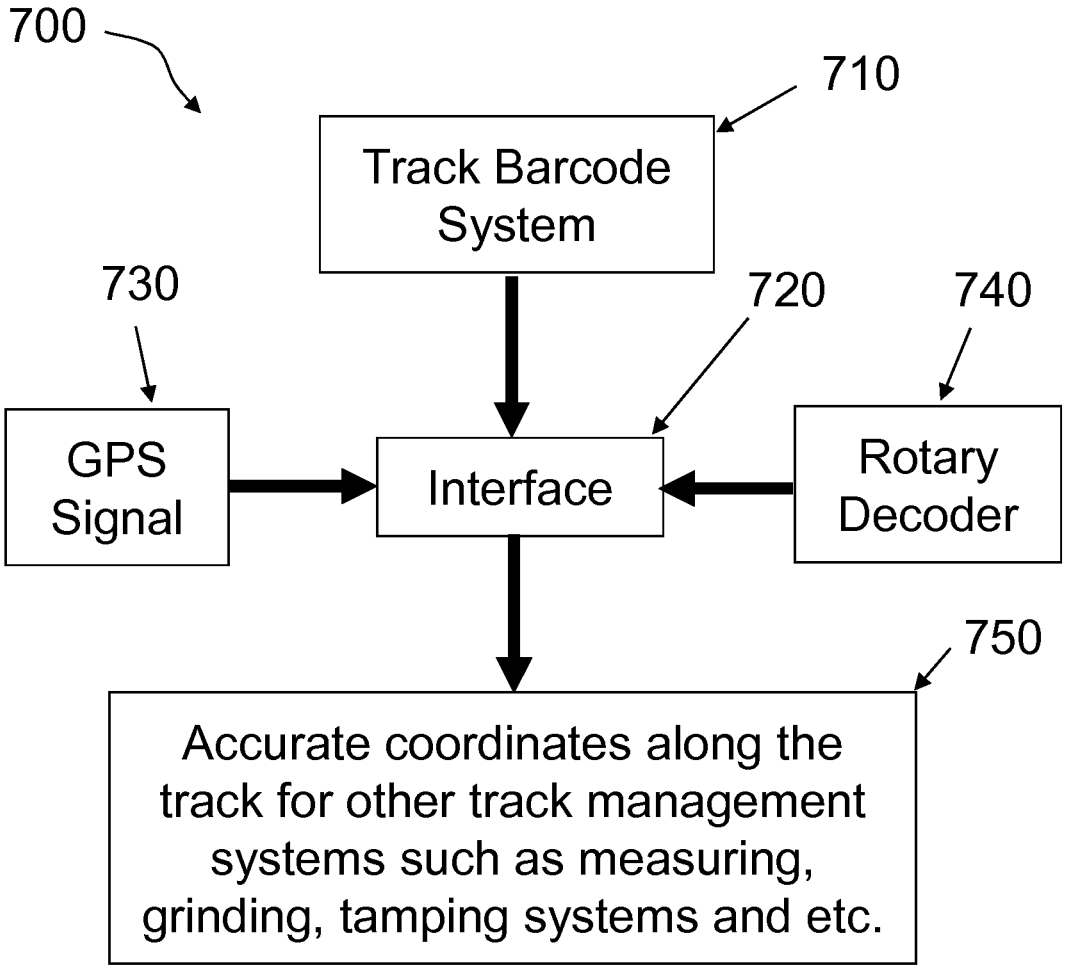
FIG. 8 shows a chart diagram for the applications of the track barcode systems of the present invention.

FIG. 8 shows a chart diagram 700 for the applications of the track barcode systems of the present invention. The track barcode system 710 could be any of the track barcode systems discussed above, which consists of at least one array of barcodes attached to the track of a railroad at predetermined locations, and at least one barcode scanner installed on a moving vehicle, with the barcode scanner directed at the corresponding array of the barcodes. The barcode scanner can provide two signals through an interface 720 to any track management systems 750. One of the signals is a trigger whenever the barcode scanner, which moves along the tracks with the vehicle, detects the existence of a barcode. The other signal contains the track coordinate or other information precoded on the barcode. The track barcode systems 710 of the present invention can provide accurate and repeatable track coordinates along the tracks for any track management systems. The track coordinates provided by the track barcode system 710 of the present invention could be as accurate as a few centimeters. A GPS device 730 could be integrated with the track barcode system through the interface 720 to provide global information of each barcode. Rotary decoder 740 could be used to determine the locations on the track between track coordinates defined by the track barcode system of the present invention.

The track barcode system 710 of the present invention has advantages of being repeatable, accurate, practical and affordable. The trigger signal and track coordinates provided by the track barcode system 710 of the present invention can be used by other track management systems 750 such as track gauge measurement system, rail profile measurement system, grinding machine, tamping machine or other systems which need repeatable and accurate track coordinates.

As those of ordinary skill in the art can appreciate, the track barcode systems of the present invention can have other applications where the need exists for a repeatable and accurate track coordinates. It is to be understood that the description of the embodiment(s) in this application is (are) intended to be only illustrative, rather than restrictive, of the present invention. Those of ordinary skill will be able to make certain additions, deletions, and/or modifications to the embodiment (s) of the disclosed subject matter without departing from the spirit of the invention or its scope, as defined by the appended claims.

What is claimed is:

1. A railroad track barcode system comprising:

(a) a plurality of barcodes, each barcode encoding railroad track location coordinates and railroad property information;

(b) a plurality of labels carrying said plurality of barcodes on a one-for-one basis, wherein said plurality of labels are attached firmly to a rail of the railroad track at predetermined locations along said railroad track marking said track location coordinates and railroad property information;

(c) one or more barcode scanners capable of optically reading and decoding said plurality of barcodes, to provide said contents of said plurality of barcodes; and (d) a vehicle capable of moving on said railroad track, carrying said one or more barcode scanners wherein said one or more barcode scanners automatically read and decodes said plurality of barcodes when the vehicle moves by said plurality of barcodes;

wherein each of said plurality of labels includes a cover, preventing said plurality of labels from exposure to dust and pollutants, wherein said cover includes a hinge mechanism to allow said cover to be flipped over by a device of the vehicle so that said one or more barcode scanners can scan said label.

2. The track barcode system according to claim 1 wherein said vehicle device includes a gas nozzle, wherein said gas nozzle blows gas to said cover to flip said cover over so that said one or more barcode scanner can read and decode said barcode on said label.

3. The track barcode system according to claim 2 wherein said vehicle further includes a sensor to detect said cover and a valve to switch on and off said gas nozzle when said sensor detects the existence of one of said plurality of covers.

4. The track barcode system according to claim 2 wherein said gas nozzle is a compressed air nozzle.

5. A railroad track barcode system comprising:

(a) a plurality of barcodes, wherein each barcodes railroad track location coordinated and railroad property information;

(b) a plurality of labels carrying said plurality of barcodes on a one-for-one basis, wherein said plurality of labels are attached firmly to a rail of the railroad track at predetermined locations along said railroad track marking said track location coordinates and other railroad property information;

(c) one or more barcode scanners capable optically reading and decoding said plurality of barcodes, to provide said contents of said plurality of barcodes; and (d) a vehicle capable of moving on said railroad track, carrying said one or more barcode scanners and directing said one or more barcode scanners at said plurality of barcodes;

wherein said vehicle includes a gas or liquid nozzle, wherein said gas or liquid nozzle blows gas or injects liquid respectively to said plurality of labels to clean said plurality of labels before said one or more barcode scanners moving by said plurality of barcodes automatically reads and decodes said plurality of barcodes.

6. The track barcode system according to claim 5 wherein said vehicle further includes a sensor to detect said plurality of labels and a valve to switch on and off said gas or liquid nozzle when said sensor detects the existence of one of said plurality of labels.

7. The track barcode system according to claim 5 wherein said gas nozzle is a compressed air nozzle, and said liquid nozzle is a water nozzle.

8. A railroad track barcode system comprising:

(a) a plurality of barcodes, each barcode encoding railroad tracks location coordinates and railroad property information;

(b) a plurality of labels carrying said plurality of barcodes on a one-for-one basis, wherein said plurality of labels are attached firmly to a rail of the railroad track at predetermined locations along said railroad track marking said track location coordinates and other railroad property information;

(c) one or more barcode scanners capable of optically reading and decoding said plurality of barcodes optically, to provide said contents of said plurality of barcodes; and (d) a vehicle capable of moving on said railroad track, carrying said one or more barcode scanners and directing said one or more barcode scanners at said plurality of barcodes;

wherein said vehicle includes both a liquid nozzle and a gas nozzle, wherein said liquid nozzle and said gas nozzle injects liquid firstly and blows gas secondly to said plurality of labels to wash, clean and dry said plurality of labels before said one or more barcode scanners moving by said plurality of barcodes automatically reads and decodes said plurality of barcodes.

9. The track barcode system according to claim 8 wherein said vehicle further includes a sensor to detect said label, a first valve to switch on and off said liquid nozzle firstly and a second valve to switch on and off said gas nozzle secondly when said sensor detects the existence of one of said plurality of labels.

10. The track barcode system according to claim 8 wherein said liquid nozzle is a water nozzle, and said gas nozzle is a compressed air nozzle.

* * * * *